United States Patent [19]

Snaper et al.

[11] 4,208,643

[45] Jun. 17, 1980

[54] MAGNETICALLY ACTUATED MERCURY SWITCH

[75] Inventors: Alvin A. Snaper, Las Vegas, Nev.; Gary B. Zulauf, Pinckney, Mich.

[73] Assignee: Gulf & Western Manufacturing Company, Southfield, Mich.

[21] Appl. No.: 912,220

[22] Filed: Jun. 5, 1978

[51] Int. Cl.[2] ..... H01H 29/00; H01H 29/18

[52] U.S. Cl. ..... 335/52; 200/209; 200/211; 335/49; 335/55; 335/208

[58] Field of Search ..... 335/47, 49, 51, 52, 335/55, 56, 57, 58, 208; 200/182, 209, 210, 211, 214; 337/21, 80

[56] References Cited

U.S. PATENT DOCUMENTS

| | | | |
|---|---|---|---|
| 965,549 | 7/1910 | Young | 200/209 X |
| 2,445,406 | 7/1948 | Pollard | 335/58 X |
| 2,519,463 | 8/1950 | Harrison | 335/51 X |
| 2,695,938 | 11/1954 | Hancock | 200/211 |
| 2,926,226 | 2/1960 | Kiel | 335/49 X |
| 3,161,745 | 12/1964 | Anderson | 335/52 |
| 3,209,099 | 9/1965 | Zearfoss | 335/208 |

*Primary Examiner*—Fred L. Braun

*Attorney, Agent, or Firm*—Meyer, Tilberry & Body

[57] ABSTRACT

In a switching device having first and second conductor elements and an operating mechanism shiftable to and from a first position wherein the conductor elements are electrically connected to each other to establish a conductive path therebetween. The device includes a body of mercury, and a mercury wettable porous member between the mercury body and the first conductor element so that the mercury from the body may be forced through the porous body to establish the above-mentioned electrical connection. When the shiftable mechanism is shifted into the first position, the mercury is withdrawn from the first conductor element by the wettable porous member to disconnect the electrical circuit.

25 Claims, 6 Drawing Figures

12
12a
60
50
A
a
20
M
10
32
30
22
24
y
SOL.
34
36
42
46
44
x
52
x =.020-.100
y =.050-.100
L1
40
L1
L2
LOAD
L2
14

12
12a
50
A
22
60
20
M
10
32
34
30
SOL.
R
24
36
42
46
40
44
52
L1
LOAD
L2
L1
L2
14

12
12a
60
50
22
20
M
10
32
30
SOL.
34
36
42
46
24
44
52
40
L1
LOAD
L2
L1
L2
14

MAGNETICALLY ACTUATED MERCURY SWITCH

BACKGROUND OF INVENTION

The present invention relates to the art of electrical switching devices and more particularly to an hydraulic relay using mercury in a hermetically sealed chamber to establish electrical continuity between two conductors.

The invention is particularly applicable for use in high power electrical relays and it will be described with particular reference thereto; however, it is appreciated that the invention has much broader applications and may be used in various switching devices for establishing electrical current between two spaced conducting elements. In many relays which carry a substantial amount of current there are provided movable metallic contacts that engage fixed contacts. When the contacts are opened, there is a tendency to arc. This can erode the contacts. In addition, after long use the contacts often become dirty and contaminated which prevents tight engagement and also changes the electrical characteristics. In an attempt to overcome the difficulties of using the metal contacts, some relays employ a mercury pool or use mercury wetting of the contact area to reduce the arcing during operation of the contacts. The use of mercury does reduce the tendency of arcing and does maintain a certain amount of uniformity of electrical resistance and other characteristics during prolonged use of the relay; however, the use of a mercury pool has presented certain undesirable features. For instance, the relay may be sensitive to orientation or position. Thus, the relay must be mounted in a certain position. Also, mercury in relay structure is susceptible to vibrations and shock which will distract from its universal usefulness. Generally, the relays having a mercury pool at the metal contacts use the metal contacts themselves for the conductive path. Initially, this use of mercury to prevent erosion is quite successful; however during prolonged use there must be provisions for replenishing the film used in the contact area. A sample of this type of unit is illustrated in Pollard U.S. Pat. No. 2,454,406.

Mercury also has been used in electrical switches by employing a body of mercury itself as the actual interconnecting conductor between two fixed contacts. Such a system is shown in Young U.S. Pat. No. 2,766,396. In this instance, a wire gauze is incorporated to prevent damage to the fragile enclosure by the mercury during shipment and other times of extreme vibration. Still a further prior patent showing the use of a mercury pool as the actual interconnecting conductor between adjacent fixed conductors is Hancock U.S. Pat. No. 2,695,938 and O'Neil U.S. Pat. No. 2,721,317. In each of these instances, a bellows is used to force mercury into a conducting position. Release of pressure from the bellows allows the mercury to break electrical contact through the mercury bath and disconnect the electrical conductive path. It is with this background regarding the use of mercury in an electrical switching device that the present invention has been made.

THE INVENTION

In accordance with the present invention, there is provided a switching device or relay wherein the electrical contact between two conductor elements is established by the use of a body of commercial grade mercury. In accordance with the present invention, there is provided a passage through which the mercury passes somewhat similar to the passage shown in Hancock U.S. Pat. No. 2,695,938 and O'Neil U.S. Pat. No. 2,721,317. In accordance with the present invention, this passage includes an opening which faces the flat surface of an electrical contact means and the opening is closed by a mercury wettable porous metal member, such as a plug of wire mesh formed from a mercury wettable metal, preferably copper or copper alloy. This plug, in the preferred embodiment, is somewhat like steel wool formed from a copper or copper alloy instead of bare steel. Essentially, it is fine metal threads matted into a coherent mass. By using this type of plug at the outlet of the passage, when pressure is applied to the mercury it is forced outwardly from the opening against the flat surface of an electrical contact member. As the pressure is relieved, the wettable member draws or sucks the mercury back into the passage and disconnects the electrical engagement of the mercury with the conductor element initially engaged by the mercury. The metal plug can be considered as a metal felt structure which is mercury wettable and has a large surface area due to the mass of metal wires in the plug.

In accordance with the present invention, there is provided an improvement in a switching device of the type generally described above, which switching device includes a body of mercury, a mercury wettable porous member between the body of mercury and one of the conductor elements, means electrically connecting the mercury body to a second conductor element, means responsive to an operating mechanism for forcing the mercury through the member into engagement with the second conductive element and means responsive to another position of the operating mechanism for allowing the mercury body to be withdrawn from the first conductor element by the wetting action of the porous member. In accordance with the preferred embodiment of the present invention, the mercury wettable member is a wire gauze of copper or copper alloy having a nominal wire diameter of approximately 0.002 inches and formed together in a mass sufficient to form a flow barrier until pressure is applied to the mercury behind the member. The large surface area of the wettable material in the plug allows the plug to withdraw the mercury from its position establishing an electrical path when pressure is relieved from the mercury behind the metal plug.

By utilizing the mercury wettable element or plug to discontinue the conductive path, the switching device is not orientation sensitive. It may be mounted in various dispositions. In addition, vibrations will not cause inadvertent electrical connection through the switching device because of flow barrier action of the plug. Consequently, the invention is clearly distinguished from the prior patents mentioned in the introductory portion of this specification.

In accordance with another aspect of the present invention, the mercury switching concept is employed in a solenoid actuated relay wherein the armature is connected to a bellows that forces the mercury body through an opening closed by the wire gauze or other porous metal plug or slug. In accordance with still a further aspect of the invention, the magnetic path through the solenoid relay includes a metal element or semiconductor material element having a Curie Point temperature. This element is mounted in the magnetic path and adjacent one of the conductive elements of the electrical path. If the Curie Point element heats to its Curie Point temperature, the element experiences a drastic reduction in its permeability. This increases the reluctance of the magnetic path of the relay and causes release of the armature to drop the pressure exerted on the bellows by the armature. This reduces the pressure on the mercury body and disconnects the electrical circuit through the solenoid actuated relay device. Consequently, the present invention employs not only a hydraulic relay in its broadest sense, but also a hydraulic relay incorporating a heat responsive disconnecting feature.

The primary object of the present invention is the provision of a switching device, which device uses mercury as the connecting media and is not orientation sensitive or subject to variations due to vibrations or shock.

Another object of the present invention is the provision of a switching device, as defined above, which switching device is positive in operation and employs a mercury wettable porous metal member, such as a matted mass of mercury wettable metal thread or wire. This porous metal member controls communication of the mercury with a surface of a contact element for connecting and disconnecting the switching device.

Another object of the present invention is the provision of a device of the type described above, which device uses a body of mercury as a conducting media and means for forcing a portion of the body of mercury through the porous member to make contact and for allowing the mercury to draw back into the body through the member to break electrical contact.

Still a further object of the present invention is the provision of a switching device of the type defined above, which device includes an efficient heat responsive disconnect member which breaks the electrical contact when the temperature exceeds a given level and which includes no moving parts.

These and other objects and advantages will become apparent from the following description.

BRIEF DESCRIPTION OF DRAWINGS

The following drawings are incorporated herein.

PREFERRED EMBODIMENT OF THE INVENTION

Figure 1:
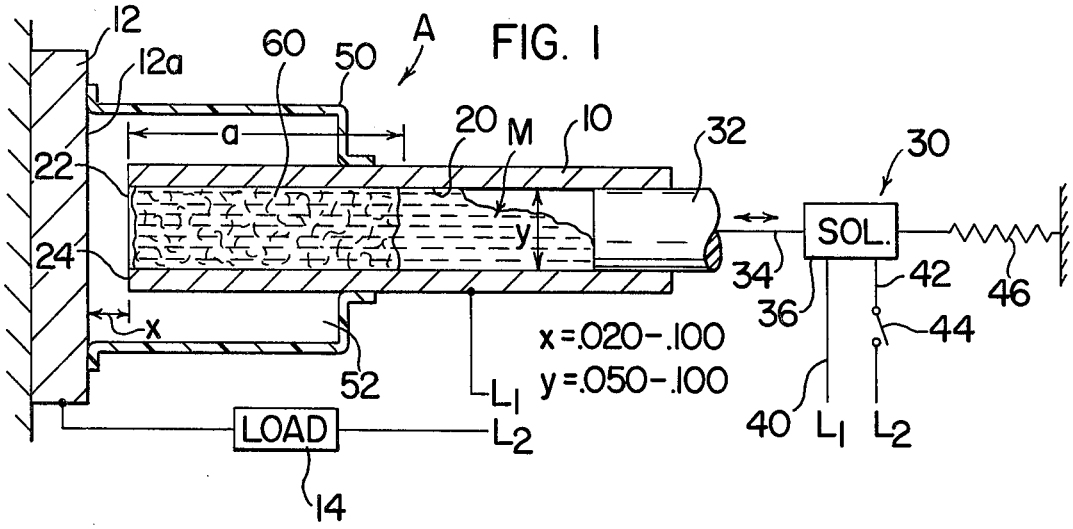
FIG. 1 is a schematic diagram illustrating inventive concepts of the preferred embodiment of the present invention.
Figure 2:
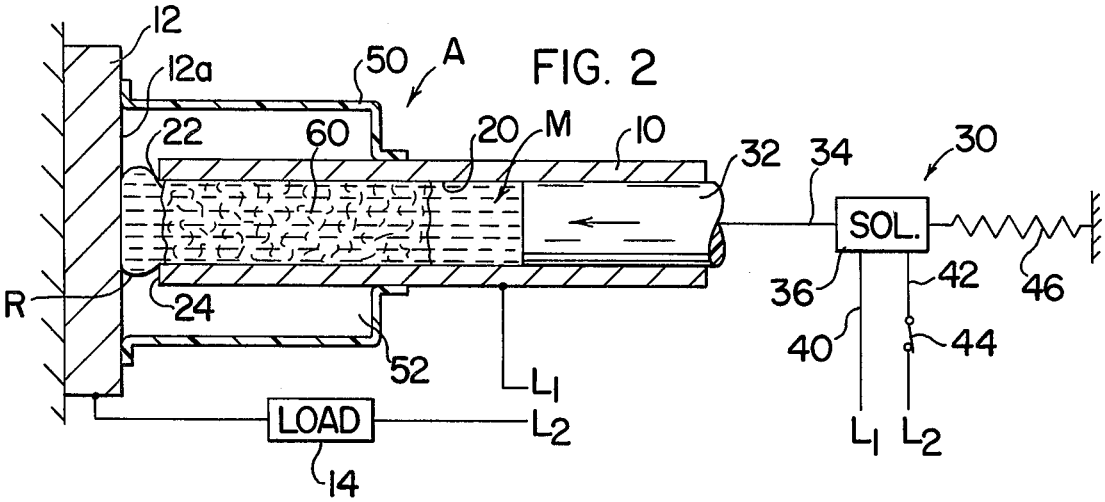
FIGS. 2 and 3 are schematic diagrams, similar to FIG. 1, illustrating operating characteristics of the invention as disclosed in FIG. 1.
Figure 3:
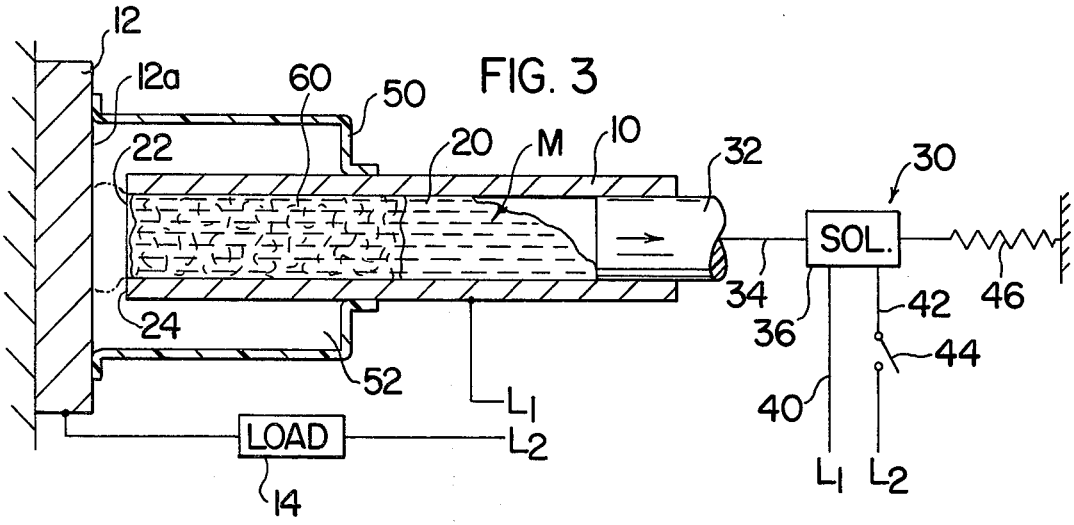

Referring now to FIGS. 1–3, there is illustrated an embodiment of the present invention showing the operating characteristics and their use in a switching device A. This schematic description is for the purpose of illustrating the invention and not for the purpose of limiting same. In the illustrated embodiment, switching device A includes conductor members 10, 12 which are connected across lines L1, L2 and in electrical series with a load 14. The conductor members may take a variety of structural shapes necessary to implement the desired embodiment of the invention and are illustrated schematically for the purpose of explaining the present invention only. Passage 20 is elongated and is illustrated as a cylindrical bore having a diameter y. This bore terminates in an opening 22 at end 24 of contact member 10, which opening is spaced a distance x from flat surface 12*a* of conductor member 12. Within a reservoir illustrated as a part of bore or passage 20 there is provided a body of mercury M which is forced from opening 22 into engagement with surface 12*a* to establish electrical continuity between lines L1 and L2. By relieving the pressure on body M, the mercury is drawn back into the reservoir or bore 20 in a manner to be described later. To pressurize the mercury forming body M, there is provided an appropriate arrangement which is schematically shown as an operating mechanism 30 having a plunger 32 reciprocated within bore 20 by a connector 34 driven, in turn, by solenoid 36. Power is supplied to solenoid 36 by lines 40, 42 connected to the power supply lines L1, L2, respectively. An appropriate switch 44 actuates solenoid 30 to move plunger 32 to the left for pressurizing mercury within bore 20. When switch 44 is opened, tension spring 46 returns plunger 32 to the right and relieves pressure on the body of mercury M. Consequently, selective actuation of solenoid 36 drives plunger 32 to the left a sufficient distance to push mercury through opening 22 into electrical contact with surface 12*a* of conductor member 12. The mercury operating space between opening 22 and surface 12*a*, in the illustrated embodiment, is surrounded by a hermetically sealed housing 50 formed from electrically non-conducting material. This provides a gas tight sealed chamber 52 which is filled with an inert gas, such as Argon, Nitrogen or Neon. The body of mercury M may not completely fill the volume of reservoir or bore 20 when plunger 32 is shifted to the retracted position, as shown in FIG. 1. However, it is preferred that the reservoir be substantially filled in all operating positions to prevent any vacuum action.

In accordance with the present invention, there is provided a structure to form a penetratable flow barrier adjacent opening 22 so that the mercury within the bore will not flow into the electrical contact position. The mercury must be forced through the barrier into electrical contact. This is done by exerting a force against the body of mercury within bore 20. This force pressurizes the mercury and forces it through the flow barrier to make electrical contact. When this pressure is relieved, the flow barrier, which is a mercury wettable metal fuzz, draws or sucks the mercury body from surface 12*a* back into opening 22. This type of flow barrier and mercury retracting action can be performed by various structures which are mercury wettable and porous to the mercury. In the preferred embodiment, a plug 60 is formed from copper, copper alloy, or tinned wire having a nominal diameter of approximately 0.002 inches and preferably between approximately 0.001–0.010 inches. This copper wire is formed somewhat like steel wool in that it is a matted mass of threads or wires having a substantial amount of passages therethrough with a substantial amount of surface area. The plug 60 may be formed from other material which is mercury wettable and performs the function of drawing the mercury from electrical contact with surface 12*a* when pressure is removed from the body of mercury M. For instance tin coated steel wire could be used. As shown, plug 60 has a length a which may be adjusted to provide the desired operating characteristics. In practice, this length a is approximately ⅛ inch.

As so far described, when solenoid 30 is de-energized, plunger 32 is withdrawn, as shown in FIG. 1. There is no electrical contact between conductor members 10, 12 since housing 50 is formed from an electrical insulating material. Elements 10, 12 are secured with respect to each other by an appropriate structure which is not necessary to understand the invention. When solenoid 36 is actuated, by closing switch 44, plunger 32 is moved to the left. This pressurizes the mercury within body M and forces the mercury through porous plug 60 and out opening 22 into a meniscus protuberance R forming an electrical contact between conductor members 10, 12. By de-energizing solenoid 36, plunger 32 is withdrawn as shown in FIG. 3. This allows pressure to be reduced on the body of mercury M so that the wettability and large surface area of matted plug 60 sucks or draws the mercury protuberance R from surface 12*a* back into bore 20 through opening 22. This action disconnects the electrical path between lines L1, L2 and de-energizes load 14. Shifting or operating mechanism 30 could take a variety of forms. For instance, it could be a manual lever, a solenoid which is extended by a spring and retracted by a coil or other similar mechanisms. An adjustable stop could be used to limit the amount of movement of plunger 32 and, thus, the mercury volume extruded through plug 60.

Although various sizes are possible for the spacing x and the general dimension y of opening 22, in practice, distance x is approximately 0.020–0.100 inches. In a like manner, when a cylindrical bore is used, dimension y is a diameter and is approximately 0.050–0.100 inches. Of course, opening 22 could have a variety of profiles. It could be elongated, rectangular, square, oblong, to name only a few. Opening 22 is sufficiently large to allow the mercury in body M to be forced through the opening and against surface 12*a*. Distance x is selected so that the protuberance R does not substantially droop by its own weight when extending through opening 22. In practice, distance x is generally in the range of 0.020 and 0.50. These distances and dimensions are given only for the purposes of example and other modifications could be made without departing from the intended spirit and scope of the present invention.

Figure 4:
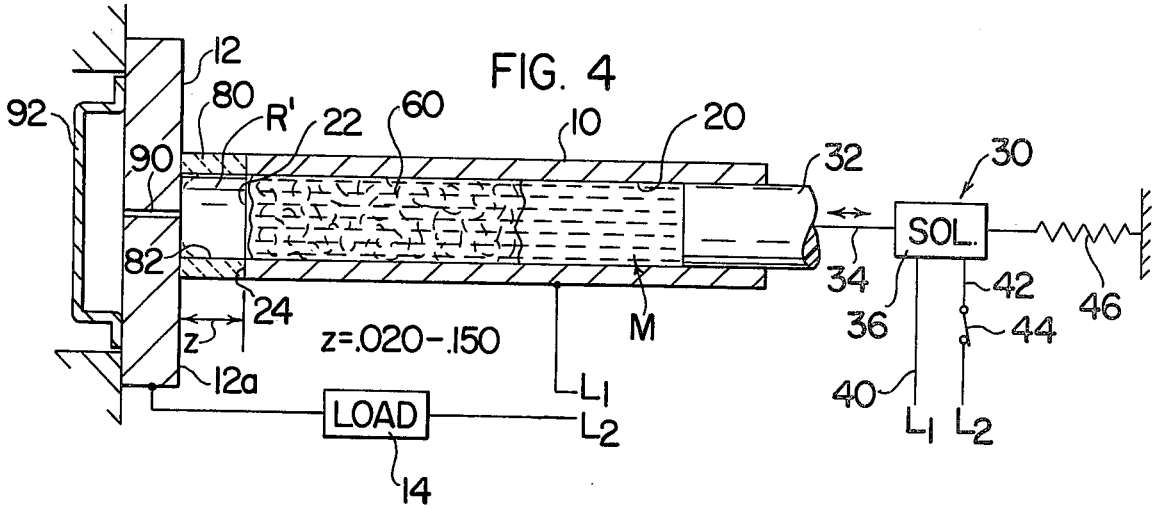
FIG. 4 is a schematic view illustrating a modification of the embodiment of the invention shown in FIGS. 1–3.

A modification of the preferred embodiment, as illustrated in FIGS. 1–3, is schematically represented in FIG. 4. In this modification, elements bear the same numbers as similar elements in the previously described embodiment. In accordance with this modification, an electrically insulated ceramic sleeve 80 extends between opening 22 and surface 12*a*. Sleeve 80 is non-wetting for mercury and includes an inner bore 82 generally matching the shape of opening 22. By providing this auxiliary sleeve, or extension to bore 20, the protuberance R′ can be somewhat larger than the protuberance R as previously described. This provides a longer column and more mercury movement for establishing the electrical connection at the outlet of porous plug 60. To allow venting of inert gas from bore 82 there is provided an appropriate small diameter vent passage 90 terminating within a hermetically sealed housing 92. This bore has a sufficiently small diameter so that mercury is not forced through the vent passage when protuberance R′ is formed by pressurizing the mercury in body M. Since contacts 10, 12 are not mercury wettable in the preferred embodiment, the mercury does not tend to move through passage 90. The modification illustrated in FIG. 4 operates in the same manner as the schematically illustrated embodiment of the invention shown in FIGS. 1–3.

Figure 5:
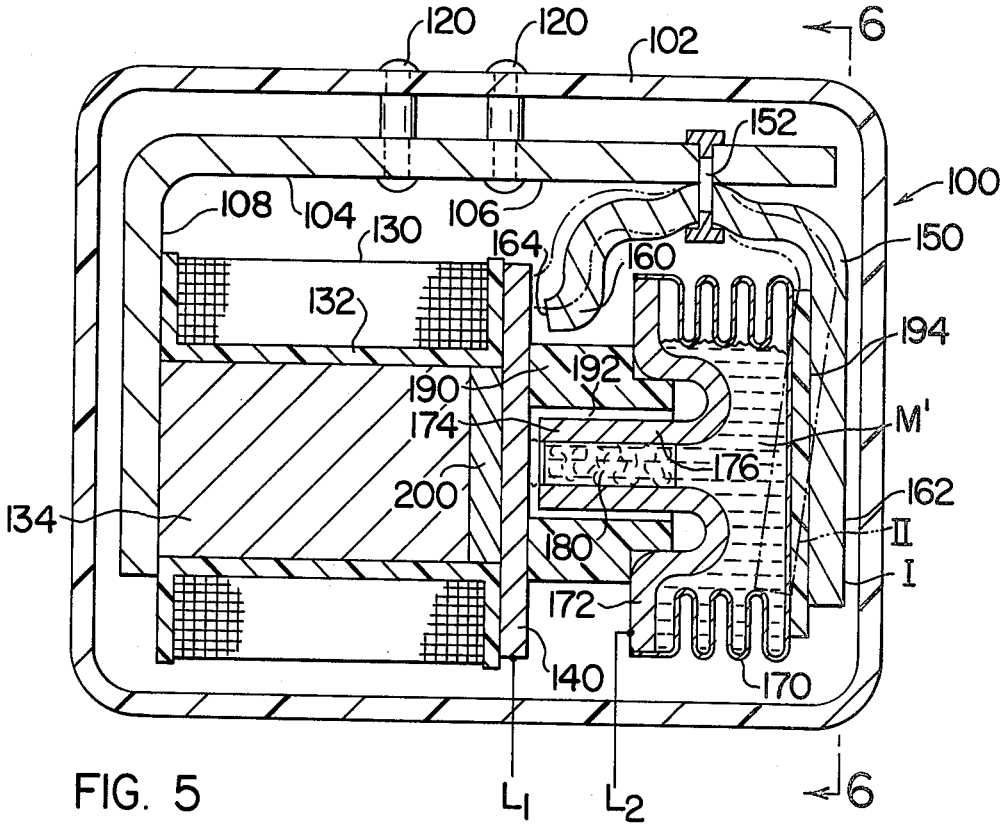
FIG. 5 is a cross-sectional view showing, somewhat schematically, the preferred embodiment of the present invention; and, FIG. 6 is an end view taken generally along lines 6—6 of FIG. 5.
Figure 6:
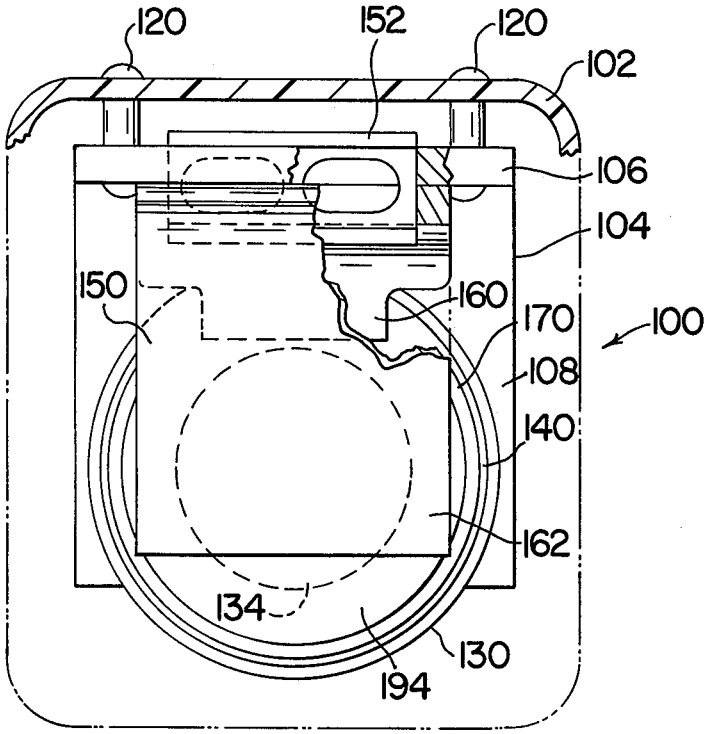

Referring now to FIGS. 5 and 6, a practical use of the invention in a relay environment is illustrated. In this environment, relay 100 includes a sealed housing 102 for supporting an L-shaped bracket 104 having orthogonal legs 106, 108. Rivets 120 secured bracket 104 onto housing 102. In accordance with standard relay practice, relay 100 includes a coil 130 supported on a spool 132 having a central, high permeability core 134. The spool supports one conductor member 140 of the relay circuit. An armature 150 is supported onto leg 106 by an appropriate pivot bracket 152 and includes spaced legs 160, 162. A face 164 of leg 160 is spaced from the upper surface of conductor element or member 140 so that as a current is passed through relay 130 in accordance with normal practice face 164 is drawn down toward the upper surface of conductor member 140. As so far explained, when coil 130 is energized, armature 150 is pivoted from the solid line position I to the phantom line position II. In accordance with this embodiment, a bellows 170 is carried by a support structure 172 which forms the second conductor member of the relay circuit. Structure 172 includes an inwardly facing neck 174 having a bore 176 into which a plug 180, similar to the plug 60 previously described, is mounted. Mercury body M′ is carried by the bellows so that compression of the bellows by armature 150 forces the mercury within body M′ through bore 176 and plug 180 into contact with the outer surface of conductor member 140. When coil 130 is de-energized, the resiliency of bellows 170 which is formed from a conductive metal releases the pressure on the mercury in body M′ allowing the mercury wettable material of plug 180 to withdraw the protuberance extending from neck 174 back into bore 176 to disconnect the electrical path between lines L1, L2 through conductor member 140 and support structure 172 of bellows 170. The operation of the mercury in this illustrated relay is essentially the same as previously described in graphic form in FIGS. 1–3. Support structure 172 is affixed to an insulating sleeve 190 that forms a hermetically sealed chamber 192 to protect the mercury from contamination during use. Chamber 192 is filled with an inert gas and performs the function of housing 50 as shown in FIGS. 1–3. To prevent current flow between bellows 170 and leg 162 of armature 150 there is provided an appropriate insulating plate 194 which serves as a bearing surface between the armature leg and the bellows for flexing the bellows during operation of the relay. Face 164 contacts the outer surface of member 140 to limit the amount of mercury forced through plug 180. Of course, in some instances face 164 in the closed position could be spaced from member 140.

In accordance with the structure shown in FIGS. 5 and 6, a Curie Point metal element 200 is provided in the magnetic path of the flux created by coil 130. This material is of the type which has a Curie Point temperature which changes the permeability of member 120 from a high permeability material to a unity or low permeability material when the Curie Point temperature is reached. In practice member 200 is formed from Ferroxcube 3E2A sold by Ferroxcube Corporation and has a Curie Point temperature of about 170° F. This member in the flux path of the relay is in heat transfer relationship with conductor element or member 140. As current flows between lines L1, L2 during electrical contact in the relay, member 140 increases in temperature according to the amount of current flow. If this increase in temperature causes member 200 to be heated above the Curie Point temperature of member 200, the reluctance created by this member substantially increases. This increase in reluctance in the magnetic path decreases the magnetic force, i.e. pulling strength, between member 140 and leg 160. Armature 150 is released and the pressure upon the mercury in body M' is decreased. This disconnects the circuit established between lines L1, L2 within relay 100.

Having thus defined the invention, it is claimed:

1. In a switching device having first and second conductor elements and an operating means for shifting between a first position with said conductor elements electrically isolated and a second position with said conductor elements electrically connected to establish a conductive path therebetween, the improvement comprising: means forming a passage having an opening facing said first conductor element; a mercury wettable porous member blocking said passage and adjacent said opening; a body of mercury; means for connecting said body of mercury to said second conductor element; and means responsive to said operating means being in said second position for forcing said mercury through said porous member and into electrical contact with said first conductor element.

2. The improvement as defined in claim 1 wherein said porous member is formed from randomly arranged metal wires.

3. The improvement as defined in claim 1 wherein said porous member is formed from fine metal threads matted into a coherent mass.

4. The improvement as defined in claim 1 wherein said operating means includes an energizable solenoid having a selected magnetic path and including a magnetically permeable metal element having a given Curie Point temperature, and means for securing said element in said path and in heat receiving relationship with said second conductor element whereby the reluctance of said path is subsequently increased when said second conductor element heats said metal element above said Curie Point temperature.

5. The improvement as defined in claim 1 wherein said operating means is an energizable solenoid having an armature movable in a first direction when said solenoid is in an energized condition and in a second direction when said solenoid is in a deenergized condition and said means for forcing said mercury being actuated by said armature moving in one of said directions.

6. In a switching device having first and second conductor elements and an operating mechanism shiftable between a first position with said conductor elements electrically isolated and a second position with said conductor elements electrically connected to establish a conductive path therebetween, the improvement comprising: a body of mercury, a mercury wettable porous member between said body of mercury and said first conductor element; means electrically connecting said mercury body to said second conductor element; means responsive to said second position of said operating mechanism for forcing said mercury through said member into engagement with said first conductive element; and means responsive to said first position of said operating mechanism for allowing said mercury body to be withdrawn from said first conductor element by the wetting action of said porous member.

7. In a switching device having first and second conductor elements and an operated mechanism shiftable between a first position with said conductor elements electrically isolated and a second position with said conductor elements electrically connected to establish a conductive path therebetween, the improvement comprising: means forming an elongated passage having a first end, a second end and an opening facing and spaced from said first conductor element; and a mercury wettable porous plug blocking said passage and adjacent said opening; operating means for holding a body of mercury in communication with said passage; means electrically connecting said body of mercury with said second conductor element; and, said operating means including means for pressurizing said mercury body when said mechanism is shifted into said second position whereby mercury from said mercury body is forced through said plug into electrical contact with said first conductive element and means for releasing said pressure from said mercury body when said mechanism is shifted into said first position whereby mercury is drawn into said passage by said plug and out of electrical contact with said first conductor element.

8. The improvement as defined in claim 7 wherein said plug is formed from randomly arranged metal wires.

9. The improvement as defined in claim 8 wherein said wires are formed from a mercury wettable metal such as copper, copper alloy, silver, silver alloy, tin, or any wire plated with same.

10. The improvement as defined in claim 7 wherein said plug is formed from fine metal threads matted into a coherent mass.

11. The improvement as defined in claim 10 wherein said metal thread is formed from a mercury wettable metal such as copper, copper alloy, silver, silver alloy, tin, or any wire plated with same.

12. The improvement as defined in claim 7 wherein said pressurizing means is a bellows containing part of said mercury body and communicating with said passage, said bellows being compressed when said mechanism is shifted into said second position and expanded when said mechanism is shifted into said first position.

13. The improvement as defined in claim 12 wherein said operating means is an energizable solenoid having an armature movable in a first direction when said solenoid is in an energized condition and in a second direction when said solenoid is in a deenergized condition and means connected to said armature for compressing said bellows when said solenoid is in a selected one of said conditions.

14. The improvement as defined in claim 13 wherein said solenoid has a selected magnetic path and including a magnetically permeable metal or semiconductor element having a given Curie Point temperature, and means for securing said element in said path and in heat receiving relationship with said second conductor element whereby the reluctance of said path is substantially increased when said second conductor element heats said metal element above said Curie Point temperature.

15. The improvement as defined in claim 12 wherein said plug is formed from randomly arranged metal wires.

16. The improvement as defined in claim 13 wherein said plug is formed from randomly arranged metal wires.

17. The improvement as defined in claim 7 wherein said operating means includes an energizable solenoid having a selected magnetic path and including a magnetically permeable metal element having a given Curie Point temperature, and means for securing said element in said path and in heat receiving relationship with said second conductor element whereby the reluctance of said path is subsequently increased when said second conductor element heats said metal element above said Curie Point temperature.

18. The improvement as defined in claim 17 wherein said plug is formed from randomly arranged metal wires.

19. The improvement as defined in claim 7 wherein said operating means is an energizable solenoid having an armature movable in a first direction when said solenoid is in an energized condition and in a second direction when said solenoid is in a deenergized condition and said means for pressurizing said mercury being actuated by said armature moving in one of said directions.

20. The improvement as defined in claim 19 wherein said plug is formed from randomly arranged metal wires.

21. The improvement as defined in claim 7 including means forming a gas tight sealed chamber extending between said opening and said second conductor element.

22. The improvement as defined in claim 8 including means forming a gas tight sealed chamber extending between said opening and said second conductor element.

23. The improvement as defined in claim 7 including an electrical insulating sleeve matching said opening and extending between said opening and said second conductor element.

24. The improvement as defined in claim 8 including an electrical insulating sleeve matching said opening and extending between said opening and said second conductor element.

25. The improvement as defined in claim 19 including an electrical insulating sleeve matching said opening and extending between said opening and said second conductor element.

* * * * *